US010443311B2

(12) United States Patent
Koch et al.

(10) Patent No.: US 10,443,311 B2
(45) Date of Patent: Oct. 15, 2019

(54) TOP SURFACE DRILLING DEVICE AND METHODS FOR DRILLING A CORE IN A TOP SURFACE

(71) Applicant: TRACTO-TECHNIK GmbH & Co. KG, Lennestadt (DE)

(72) Inventors: Elmar Koch, Eslohe (DE); Andreas Joachim Hanses, Lennestadt (DE); Sebastian Fischer, Lennestadt (DE); Martin Köper, Attendorn (DE)

(73) Assignee: TRACTO-TECHNIK GMBH & CO. KG, Lennestadt (DE)

( * ) Notice: Subject to any disclaimer, the term of this patent is extended or adjusted under 35 U.S.C. 154(b) by 252 days.

(21) Appl. No.: 15/078,698

(22) Filed: Mar. 23, 2016

(65) Prior Publication Data

US 2016/0281433 A1 Sep. 29, 2016

(30) Foreign Application Priority Data

Mar. 27, 2015 (DE) ..... 10 2015 003 909

(51) Int. Cl.

| | |
|---|---|
| ***E21B 10/02*** | (2006.01) |
| ***E21B 7/04*** | (2006.01) |
| ***E21B 4/00*** | (2006.01) |
| ***E21B 7/00*** | (2006.01) |
| ***E21B 10/64*** | (2006.01) |

(52) U.S. Cl.

CPC ..... *E21B 10/02* (2013.01); *E21B 4/006* (2013.01); *E21B 7/002* (2013.01); *E21B 7/046* (2013.01); *E21B 10/64* (2013.01)

(58) Field of Classification Search

CPC ..... E21B 10/26; E21B 25/00

See application file for complete search history.

(56) References Cited

U.S. PATENT DOCUMENTS

| | | | | |
|---|---|---|---|---|
| 2,599,770 | A * | 6/1952 | Marcerou | B23D 59/025 125/36 |
| 2,799,872 | A * | 7/1957 | Krahnke | B23G 1/465 408/129 |
| 3,068,727 | A | 12/1962 | Wertman | |
| 3,077,936 | A * | 2/1963 | Arutunoff | E21B 10/04 175/101 |
| 3,181,631 | A | 5/1965 | Nielsen | |
| 3,391,751 | A * | 7/1968 | Caro | E02D 17/13 175/272 |
| 3,537,334 | A * | 11/1970 | Gilbert | F16H 1/12 475/1 |
| 3,778,179 | A * | 12/1973 | Rivas | B23B 51/0406 125/20 |
| 4,551,045 | A * | 11/1985 | Bossler | B23B 51/042 175/405.1 |

(Continued)

FOREIGN PATENT DOCUMENTS

| | | |
|---|---|---|
| CH | 312072 | 2/1956 |
| DE | 19704263 C1 | 8/1998 |

(Continued)

*Primary Examiner* — Shane Bomar

(74) *Attorney, Agent, or Firm* — Howard IP Law Group

(57) ABSTRACT

A top surface drilling device has a core bit and a drill head disposed in the core bit. The drill head has a smaller diameter than that of the core bit, and the core bit and the drill head can be driven at different angular speeds.

16 Claims, 1 Drawing Sheet

(56) References Cited

U.S. PATENT DOCUMENTS

| | | | | |
|---|---|---|---|---|
| 5,038,873 | A * | 8/1991 | Jurgens | E21B 4/02 175/246 |
| 5,252,009 | A * | 10/1993 | Bossler | B28D 1/18 175/386 |
| 5,253,961 | A * | 10/1993 | Geissler | B23B 31/113 173/71 |
| 5,624,213 | A * | 4/1997 | Anderson | B23B 51/0473 144/23 |
| 7,850,405 | B2 * | 12/2010 | Keightley | B23B 51/0473 279/8 |
| 9,216,459 | B2 | 12/2015 | Richt et al. | |
| 2008/0179105 | A1 * | 7/2008 | Duncan | B23B 51/0426 175/420.1 |
| 2012/0275874 | A1 * | 11/2012 | Richt | B23B 45/008 408/124 |
| 2013/0199851 | A1 | 8/2013 | Koch et al. | |
| 2015/0136490 | A1 * | 5/2015 | Broussard, Jr. | E21B 25/00 175/57 |

FOREIGN PATENT DOCUMENTS

| | | | |
|---|---|---|---|
| DE | 102010013725 | A1 | 10/2011 |
| GB | 586372 | A | 1/1953 |
| WO | 2012/027271 | A2 | 3/2012 |

* cited by examiner

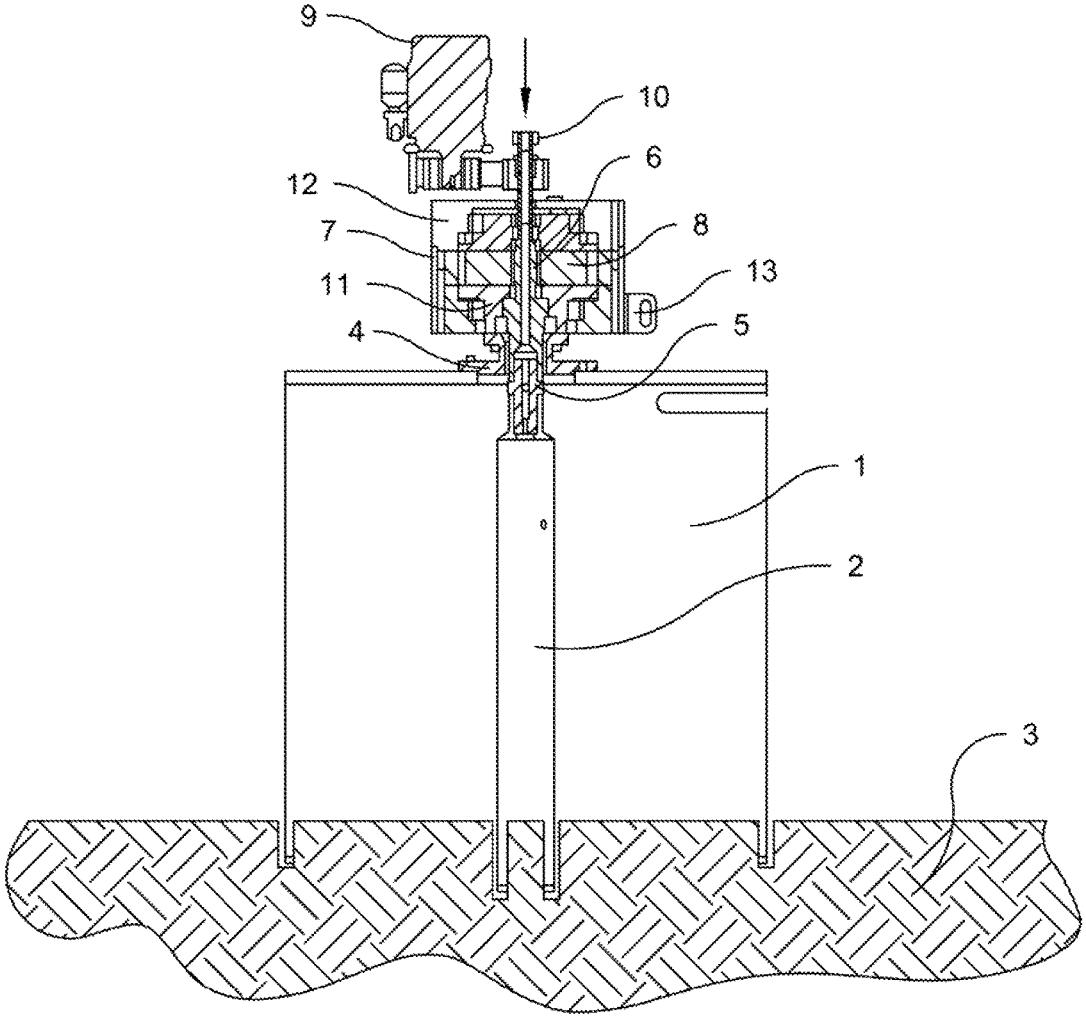
9
10
6
12
7
8
11
13
4
5
1
2
3

TOP SURFACE DRILLING DEVICE AND METHODS FOR DRILLING A CORE IN A TOP SURFACE

CROSS-REFERENCE TO RELATED APPLICATIONS

This application claims priority to German Application No. 10 2015 003 909.1 filed Mar. 27, 2015 as required by 35 U.S.C. 119(b) and 37 CFR 1.55, the entirety of which application is hereby incorporated herein by reference for all purposes.

FIELD OF INVENTION

The invention relates to a top surface drilling device and a method for drilling a core in a top surface.

BACKGROUND

When a drill hole is created in the ground, in particular a horizontal drill hole in the ground, a cavity is usually created that extends at an angle, in particular close to 90°, from the earth's surface into the ground. The drilling device, in particular a horizontal drilling device, is lowered into the cavity, which can also be described as a construction trench or an access trench. From the cavity, it is then possible to create a horizontal drill hole, in particular, using the drilling device.

In areas in which buildings have been erected, the cavity in which the drilling device is to be positioned must have a relatively small diameter. Such a small cavity is known as "keyhole technology" in the context of trenchless installation and replacement of gas, water, power or data lines for building connections. Surface work should be reduced to a minimum, in particular in areas in which buildings have been erected, in which the ground is covered with a top surface. Keyhole technology results in less of the consequential surface damage and consequential surface costs known from the open construction method. The earthwork and surface work can be realized more safely, on a smaller scale and more productively. The creation of a horizontal drill hole in the ground using keyhole technology is described in DE 10 2010 013 725 A1, for example.

In order to create a round cavity in ground covered with a top surface, a core bit in the form of a core drill is usually used initially. The top surface is cut in a circular shape by means of the core drill, with the external diameter of the core drill corresponding to the external diameter of the cavity to be created. Once the circular cut has been made, the core drill is removed and, using a core drill or another drill of lesser diameter, an additional drill hole is created, by means of which the drill core can be removed from the cavity. Three work steps are thus usually required in order to create a cavity:

1. Making a circular cut in the surface corresponding to the external diameter of the cavity to be created and removal of the core drill,
2. Creating an additional drill hole inside the circular cut made previously and
3. Removal of the drill core through lifting out of the drill core by means of a rod system introduced into the additional drill hole.

Based on this prior art, the objective of the invention is to create an improved top surface drilling device and a method for drilling a core in a top surface, by means of which a cavity can be created more efficiently, and, in particular, the number of method steps can be reduced.

SUMMARY

The objective is achieved by means of the subject matter disclosed herein.

The central idea of the invention is the combination of the two previously separately realized steps of making the circular cut and the step of creation of a drill hole inside the circular cut realized subsequently and separately therefrom According to the invention, the top surface drilling device is designed such that a drill head is disposed in a core bit, which drill head has a smaller diameter than that of the core bit. According to the invention, a drill core can be produced which can be returned to the back-filled cavity on completion of the work. The core bit and the drill head can be driven at different angular speeds, so that an optimal cutting speed can be selected for both cross sections or drill holes to be created in the form of the circular cut with the core bit and the drill head. The term "angular speed" relates to a rotation or turning of the core bit or of the drill head about the respective longitudinal axis. Different drives can be provided for the drill head and the core bit, which drives can be a part of the top surface drilling device according to the invention. The drill head and the core bit can be moveable relative to one another.

According to the invention, the term "core bit" comprises a core drill in the form of a hollow round chisel. "Top surface drilling device" is understood to mean, in particular, every core drill designed according to the invention for drilling into a top surface. The term "top surface drilling device" can also comprise every device which moves a core drill into a top surface from above the surface, in order to create a cavity for the positioning of a horizontal drilling device. The term "top surface" in particular comprises the surface layer in the field of road construction, which is also referred to as a surface layer, roadway surfacing or roadway coating. The top surface can include a material that can be asphalt, mastic asphalt, asphalt concrete, stone mastic asphalt, asphalt binder course and/or concrete.

The top surface can comprise, in addition to the actual top surface, another layer provided between the top surface and a grade, in particular a base layer.

The core bit, or the method, according to the invention, is used to create a cavity for an earth drilling device to be positioned therein for the creation of a conduit in the ground.

In a preferred embodiment, the drill head disposed in the core bit is designed as an additional core bit, with the result that, with the diameters of the drill head or of the additional core bit typically provided according to the invention, a lesser drilling effort is required than in the case of a full drill hole. The drill head is preferably centered relative to the core bit.

In a preferred embodiment, the ratio of the external diameter of the core bit to the external diameter of the drill head is in the range of approximately 2 to approximately 15, preferably in the range of approximately 4 to approximately 12, particularly preferably in the range of approximately 6 to approximately 10. Such proportions have proven to be particularly advantageous and are correspondingly easily manageable and produce good results.

In a preferred embodiment, the core bit can have a rotating speed ranging from approximately 70 to approximately 200 rotations per minute, preferably ranging from approximately 80 to approximately 180 rotations per minute, particularly preferably ranging from approximately 85 to approximately 170 rotations per minute. In a preferred embodiment, the drill head can have a rotating speed ranging from approximately 680 to approximately 1350 rotations per minute, preferably ranging from approximately 700 to approximately 1300 rotations per minute, particularly preferably ranging from approximately 750 to approximately 1280 rotations per minute. In a particularly preferred embodiment, the cutting speeds are correlated with one another so that, in particular at a rotating speed of the drill head ranging from approximately 750 to approximately 1280 rotations per minute, a rotating speed of the core bit ranging from approximately 85 to approximately 170 rotations per minute is provided or can be set.

In a preferred embodiment, the core bit and the drill head have a cutting speed ranging from approximately 2 to approximately 6 m/s, in particular ranging from approximately 2.5 to approximately 5.5 m/s.

It is most particularly preferred that the specified rotating speeds are correlated with the cutting speed.

In a preferred embodiment, the core bit and the drill head can be driven by means of a rotary drive having one or more gear mechanisms so that one and the same rotary drive can drive both the core bit and the drill head (moveable relative to one another), and thus no additional drive must be provided for the additional drill head. It is however also possible that, for the rotational drive of the core bit and the drill head, different (rotary) drives are provided, i.e. one drive for the core bit and one drive for the drill head.

In a preferred embodiment, the gear mechanism, or at least one of the gear mechanisms, can be a planetary gearing which enables a design that is simple and economical and that also requires only a small installation space. The planetary gearing also allows selection of the speed and torque for the core bit and the drill head adapted to the desired operating situation by means of appropriate selection of the number of teeth and also by means of the replacement of the planetary gears, the sun gear and/or the ring gear with a different number of teeth.

The planetary gearing can comprise a sun gear and a ring gear and one or more planetary gears. Such planetary gearings are known from the prior art and can have a construction in which the sun gear and the planetary gears are formed as toothed gears with external teeth and the ring gear is formed as an annular toothed gear with at least one set of internal teeth. The planetary gears can be disposed between the sun gear and the ring gear and engage with the corresponding teeth of these gears. The planetary gears can be connected with one another via a cage in order to enable the output of a rotary output, connected to the cage, to be provided across all of the planetary gears.

The sun gear can be connected to the drill head and to the drive designed as a rotary drive. The ring gear can be stationary in a housing. The planetary gear or planetary gears can engage with the driven sun gear and can be in engagement with the stationary ring gear, which causes the planetary gear or the planetary gears to rotate with a planetary gear support in the same direction as the sun gear in a predetermined gear transmission ratio. The planetary gear support can be connected to the core bit by means of a connection piece. The drive can thus drive the sun gear directly. The planetary gear or the planetary gears are indirectly driven by the drive via the sun gear.

However, it may also be provided that one or more drives are provided for one or more planetary gears, by means of which these planetary gears are driven. The at least one planetary gear, in particular the planetary gear support, can be stationary. In particular, the drive or drives for the planetary gear or the planetary gears can also be stationary. It can also be provided that the ring gear can be driven and a planetary gear support, which is stationary, is provided.

In a preferred embodiment, the core bit and the drill head can be driven with different rotation directions, so that the torques generated by the core bit and the drill head can at least partially cancel one another out. When a planetary gearing is used, a corresponding advantage can be achieved by means of an inherently different rotation of the core bit and the drill head.

The invention also provides a method for drilling a core in a top surface for the creation of a cavity, particularly for an earth drilling device and in particular a horizontal drilling device. A method according to the invention comprises a step of drilling with a core bit and drilling with an additional drill head of smaller diameter than the core bit during the drilling with the core bit, wherein the drill head and the core bit are rotated or driven at different angular speeds. In the method, the angular speed of the core bit and/or of the drill head can be selected such that an optimal cutting speed can be set for the core bit and also for the drill head. The angular speed can be adjusted according to the diameter of the drill head and the core bit.

Once the core has been removed, the material located under the top surface, in particular earth, can be flushed out of the cavity to be created.

According to the invention, the chronological term "during" comprises a time period in which both the core bit and the drill head are simultaneously advanced into the top surface. A feed of the drill head into the top surface can be provided, which can be associated with the time period in which both the core bit and the drill head can be simultaneously advanced.

In a preferred embodiment of the method, the core bit and the drill head can be driven with different rotation directions, with the torques generated by the core bit and the drill head being able to at least partially cancel one another out.

According to the invention, a circular cut through a top surface can be made more easily, for creation of a cavity for an earth drilling device, in particular a horizontal drilling device.

The above statements and the following description of exemplary embodiments do not in any way rule out specific embodiments or features.

BRIEF DESCRIPTION OF THE DRAWINGS

The invention is explained in greater detail below with reference to an exemplary embodiment depicted in the drawing.

In the drawings:

FIG. 1 a top surface drilling device.

DETAILED DESCRIPTION

The one FIGURE shows a top surface drilling device having a core bit 1 and a drill head 2. The core bit 1 is designed as a core drill in the form of a hollow round chisel. The drill head 2 is also designed as a core drill and is disposed inside the core bit 1. The drill head 2 has a smaller diameter than the core bit 1.

The core bit 1 and the drill head 2 can be driven or moved relative to one another by means of a drive designed as a rotary drive. The movement of the core bit 1 and the drill head 2 in the vertical direction occurs simultaneously; The core bit 1 and the drill head 2 are simultaneously sunk and simultaneously cut through or drill into the top surface 3 depicted in the FIGURE. A certain feed of the drill head 2 can enable the centering of the core bit 1. A feed, not depicted, and/or the weight force of the top surface drilling device can ensure the simultaneous sinking of the core bit 1 and the drill head 2.

The core bit 1 is connected to a connection piece 4. The connection piece 4 is connected to a planetary gear support 11, which supports one or more planetary gears 8. The drill head 2 is connected to a sun gear 6 by means of a connection piece 5. The sun gear 6 is, in turn, connected to a (rotary) drive 9. A ring gear 7 sits in a housing 12. A torque support 13 attached to a frame, which is not depicted, prevents the simultaneous rotation of the housing 12, and in particular the ring gear 7. The sun gear 6 and the connection piece 5 are formed as a hollow shaft, so that coolants or drilling means can be supplied to the core bit 1 and the drill head 2 via a connection 10. The drive 9 indirectly or directly drives the sun gear 6 and the drill head 2. The rotating sun gear 6 engages with the planetary gears 8, which are, in turn, in engagement with the stationary ring gear 7, which results in the planetary gears 8 rotating together with the planetary gear support 11 in the same direction of rotation as the sun gear 6, but with a specific gear transmission ratio which, in this embodiment, lies in the range of 8. By means of the connection piece 4, the core bit 1 rotates together with the planetary gears 8 and the planetary gear support 11.

The invention claimed is:

1. A top surface drilling device for creating a cavity in a top surface for a horizontal drilling device in relation to roadway construction, comprising:

a first core bit for creating an annular first removable core in the top surface; and a second core bit disposed in the first core bit for creating a cylindrical second removable core in the top surface, the second core bit having a smaller diameter than a diameter of the first core bit;

a gear mechanism configured to drive the first core bit and the second core bit simultaneously at different angular speeds;

wherein removal of the first removable core and the second removable core creates the cavity in the top surface for the horizontal drilling device; and wherein the first removable core and the second removable core created by the first core bit and the second core bit are reinsertable into the cavity in the top surface.

2. The top surface drilling device according to claim 1, wherein a ratio of an external diameter of the first core bit to an external diameter of the second core bit is in the range of approximately 2 to 15.

3. The top surface drilling device according to claim 1, wherein the gear mechanism is configured to be operably connected to a drive and wherein the gear mechanism is operably disposed between the drive and the first core bit and the second core bit, the gear mechanism being operably connected to the first core bit and the second core bit for driving the first core bit and the second core bit.

4. The top surface drilling device according to claim 3, wherein the gear mechanism is a planetary gearing.

5. The top surface drilling device according to claim 4, wherein the planetary gearing has a stationary ring gear and at least one planetary gear, configured to be driven by the drive.

6. The top surface drilling device according to claim 5, wherein the planetary gearing further comprises a sun gear connected to the second core bit and configured to be connected to the drive, wherein the planetary gear can be indirectly driven by the drive via the sun gear.

7. The top surface drilling device according to claim 4, wherein the planetary gearing has a ring gear and at least one stationary planetary gear, the stationary planetary gear configured to be driven by the drive.

8. The top surface drilling device according to claim 1, wherein the first core bit and the second core bit are driven simultaneously with different rotation directions.

9. The top surface drilling device according to claim 5, further comprising, for each one of the at least one planetary gear, a drive.

10. A method for drilling a core in a top surface for the creation of a cavity for a horizontal drilling device in relation to roadway construction, comprising:

drilling with a first core bit at a first angular speed to define a circular cut for creating an annular first removable core in the top surface;

simultaneously with the drilling with the first core bit, drilling with a second core bit of smaller diameter than the first core bit for creating a cylindrical second removable core in the top surface, at a second angular speed different from the first angular speed to create a drill hole inside the circular cut;

removing the second removable core;

introducing a rod system into the drill hole created by removal of the second removable core; and removing the first removable core using the rod system;

wherein removal of the first removable core and the second removable core creates the cavity in the top surface for the horizontal drilling device; and wherein the first removable core and the second removable core created by the first core bit and the second core bit are reinsertable into the cavity in the top surface.

11. The method according to claim 10, wherein the drilling with the first core bit and the drilling with the second core bit are performed in different rotation directions.

12. A top surface drilling device for creating a cavity in a top surface for a horizontal drilling device in relation to roadway construction, comprising:

a first core bit for creating an annular first removable core in the top surface;

a second core bit disposed in and concentric with the first core bit for creating a cylindrical second removable core in the top surface, the second core bit having a smaller diameter than a diameter of the first core bit;

a planetary gearing comprising a sun gear, a ring gear and one or more planetary gears, the sun gear and the ring gear engaging with the one or more planetary gears, the sun gear operatively connected to the second core bit, and the one or more planetary gears operatively connected to the first core bit, wherein removal of the first removable core and the second removable core creates the cavity in the top surface for the horizontal drilling device; and wherein the first removable core and the second removable core created by the first core bit and the second core bit are reinsertable into the cavity in the top surface.

13. The top surface drilling device according to claim 12, wherein the first core bit is in the form of a hollow chisel.

14. The top surface drilling device according to claim 12, further comprising a housing, the ring gear mounted stationary in the housing.

15. The top surface drilling device according to claim 12, further comprising a connection piece connected to the sun gear, the connection piece and the sun gear formed as a hollow shaft.

16. The top surface drilling device according to claim 12, wherein removal of the second removable core provides access to an underside of the first removable core to facilitate removal of the first removable core.

* * * * *